US008794218B2

(12) United States Patent
Murtha

(10) Patent No.: US 8,794,218 B2
(45) Date of Patent: Aug. 5, 2014

(54) RECLAIM INTERNAL COMBUSTION ENGINE

(76) Inventor: Robert L. Murtha, Racine, WI (US)

( * ) Notice: Subject to any disclaimer, the term of this patent is extended or adjusted under 35 U.S.C. 154(b) by 676 days.

(21) Appl. No.: 12/953,886

(22) Filed: Nov. 24, 2010

(65) Prior Publication Data

US 2011/0120429 A1 May 26, 2011

Related U.S. Application Data

(60) Provisional application No. 61/264,606, filed on Nov. 25, 2009.

(51) Int. Cl.
*F02B 47/08* (2006.01)
*F02B 47/10* (2006.01)

(52) U.S. Cl.
USPC ..... 123/568.11; 123/568.13

(58) Field of Classification Search
USPC ..... 123/58.8, 568.11, 568.13, 568.17; 60/620
See application file for complete search history.

(56) References Cited

U.S. PATENT DOCUMENTS

| | | | | |
|---|---|---|---|---|
| 4,321,892 | A * | 3/1982 | Anger | 123/58.8 |
| 6,553,977 | B2 * | 4/2003 | Schmitz | 123/561 |
| 2010/0077987 | A1 * | 4/2010 | Voisin | 123/25 C |

* cited by examiner

*Primary Examiner* — Stephen K Cronin
*Assistant Examiner* — Elizabeth Hadley
(74) *Attorney, Agent, or Firm* — Klarquist Sparkman, LLP

(57) ABSTRACT

An internal combustion engine is provided with at least two reclaim cylinders for each two fuel burning cylinders. A plurality of routing members, such as hoses, are provided to route exhaust gas from the fuel burning cylinders to the reclaim cylinders.

17 Claims, 16 Drawing Sheets

EXHAUST ROUTING

The first one-half volume of exhaust from the fuel burning cylinders #1 & #4 is routed to the intake valve of the reclaim cylinder #2.

The second one-half volume of exhaust from the cylinders #1 &#4 is routed to the intake valve of the reclaim cylinder #3.

The first one-half volume of exhaust from the fuel burning cylinders #1 & #4 is routed to the intake valve of the reclaim cylinder #2.

The second one-half volume of exhaust from the cylinders #1 &#4 is routed to the intake valve of the reclaim cylinder #3.

RECLAIM INTERNAL COMBUSTION ENGINE

CROSS-REFERENCE TO RELATED APPLICATION

This application claims the benefit of U.S. Provisional Application No. 61/264,606, which was filed on Nov. 25, 2009, and is incorporated herein by reference in its entirety.

FIELD

This disclosure pertains to an apparatus and method for improving the efficiency of an internal combustion engine and, in particular, to the use of reclaim cylinders to improve the efficiency of an internal combustion engine.

BACKGROUND

In an internal combustion engine, after the power stroke is completed, there are two agents of waste that are left in the fuel burning cylinder at the bottom of the power stroke; pressure and heat. The pressure is what was created by burning the fuel, expanding the air that was collected in the cylinder during the intake stroke. By burning the fuel in the presence of this air which was compressed during the compression stroke, the heat rapidly increases the energy in the air molecules, creating pressure that forces the piston down during the power stoke. At the end of this power stroke, the wasted pressure that still remains in the fuel burning cylinder and the heat are exhausted into the atmosphere during the exhaust stroke. A gasoline engine is approximately 30% thermodynamically efficient, which equates to 70% of the potential energy in gasoline being wasted, either by not using all the air pressure that was created, or by not using all the heat energy that was developed during the 4 stroke internal combustion cycle.

SUMMARY

In one embodiment, an internal combustion engine is provided. The engine can comprise a first cylinder having a first piston, a first intake port, and a first exhaust port; a second cylinder having a second piston, a second intake port, and a second exhaust port; a third cylinder having a third piston, a third intake port, and a third exhaust port; and a fourth cylinder having a fourth piston, a fourth intake port, and a fourth exhaust port. In addition, a plurality of routing members can be provided to route exhaust from the fuel burning cylinders to reclaim exhaust burning cylinders. For, example, a first routing member can be configured to route exhaust from the first exhaust port to the second intake port and a second routing member can be configured to route exhaust from the first exhaust port to the third intake port. Similarly, a third routing member can be configured to route exhaust from the fourth exhaust port to the second intake port and a fourth routing member can be configured to route exhaust from the fourth exhaust port to the third intake port.

In specific implementations, the first piston and the fourth piston can be configured to be in timed sequence with each other. Also, the second piston can be configured to be 180 degrees offset from the first and fourth pistons, and the third piston can be configured to be 90 degrees behind the second piston. In other specific implementations, each of the first, second, third, and fourth pistons is movable within their respective cylinders to provide a power stroke, an exhaust stroke, and an intake stroke.

In other specific implementations, the exhaust stroke of the first cylinder expels heated gas from the first exhaust port, and a portion of the heated gas expelled from the first exhaust port can be directed to the second cylinder through the first routing member and into the second intake port, and a portion of the heated gas expelled from the first exhaust port can be directed to the third cylinder through the second routing member and into the third intake port. In addition, the heated gas can be expelled from the first exhaust port and directed to the second and third cylinders during their respective intake strokes. Also, the exhaust stroke of the fourth cylinder can expel heated gas from the fourth exhaust port, and a portion of the heated gas expelled from the fourth exhaust port can be directed to the second cylinder through the third routing member and into the second intake port, and a portion of the heated gas expelled from the fourth exhaust port can be directed to the third cylinder through the fourth routing member and into the third intake port.

In other specific implementations, the heated gas expelled from the fourth exhaust port is directed to the second and third cylinders during their respective intake strokes. The portion of the heated gas directed to the second cylinder through the first routing member can be about the same amount as the portion of the heated gas directed to the third cylinder through the second routing member. Also, the heated gas expelled from the first and fourth exhaust ports can be delivered to the second and third cylinders while the second and third pistons are substantially in mid-stroke of an intake stroke.

In specific implementations, the first and fourth cylinders can comprise fuel burning cylinders and the second and third cylinders comprise reclaim cylinders. The ratio of fuel burning cylinders to reclaim cylinders can be 1:1. Alternatively, the ratio of fuel burning cylinders to reclaim cylinders can be greater or less than 1:1.

The foregoing and other objects, features, and advantages of the invention will become more apparent from the following detailed description, which proceeds with reference to the accompanying figures.

DETAILED DESCRIPTION

Figure 1:
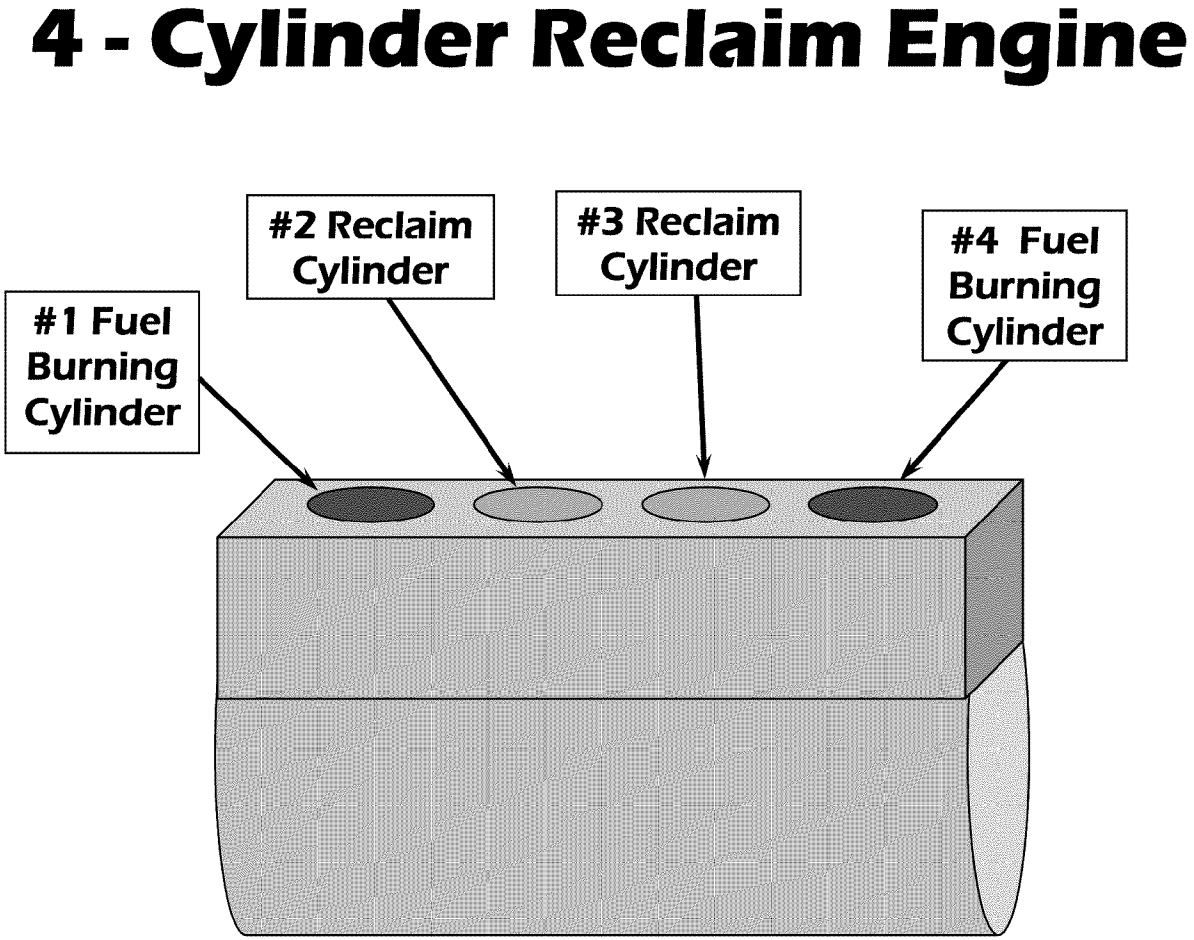
FIG. 1 illustrates the sequence of cylinders in a 4 cylinder reclaim engine.

The following description is exemplary in nature and is not intended to limit the scope, applicability, or configuration of the disclosed embodiments in any way. Various changes to the described embodiment may be made in the function and arrangement of the elements described herein without departing from the scope of the disclosure.

As used in this application and in the claims, the singular forms "a," "an," and "the" include the plural forms unless the context clearly dictates otherwise. Additionally, the term "includes" means "comprises."

Although the operations of exemplary embodiments of the disclosed method may be described in a particular, sequential order for convenient presentation, it should be understood that disclosed embodiments can encompass an order of operations other than the particular, sequential order disclosed. For example, operations described sequentially may in some cases be rearranged or performed concurrently. Further, descriptions and disclosures provided in association with one particular embodiment are not limited to that embodiment, and may be applied to any embodiment disclosed.

Moreover, for the sake of simplicity, the attached figures may not show the various ways (readily discernable, based on this disclosure, by one of ordinary skill in the art) in which the disclosed system, method, and apparatus can be used in combination with other systems, methods, and apparatuses. Additionally, the description sometimes uses terms such as "provide" to describe the disclosed method. These terms are high-level abstractions of the actual operations that can be performed. The actual operations that correspond to these terms can vary depending on the particular implementation and are, based on this disclosure, readily discernible by one of ordinary skill in the art.

As discussed above, in an internal combustion engine, after the power stroke is completed, there are two agents of waste that are left in the fuel burning cylinder at the bottom of the power stroke; pressure and heat. This wasted pressure and heat can be recaptured using reclaim cylinders as described here. These cylinders "reclaim" and use the pressure and heat that would otherwise be exhausted into the atmosphere.

In any fuel burning engine, at the bottom of the power stroke is wasted pressure, which can be discussed in terms of PSI (pounds per square inch). PSI is what forces the piston down, turning the crankshaft, creating torque. The amount of pressure remaining in the cylinder at BDC (bottom dead center) can be calculated by the equation; 1/compression ratio. If the compression ratio of the engine is 6.5:1, the pressure at BDC is 1/6.5, or 15.4% of the maximum pressure created at, or near combustion TDC (top dead center). If the maximum pressure created at TDC is 150 PSI, then the wasted pressure at the bottom of the power stroke is 0.154× 150 PSI or 23.1 PSI. When the exhaust valve is cracked, much of the "noise" on an unmuffled cylinder and the rush of air (pressure) is this wasted PSI rapidly escaping. Theoretically recapturing this wasted PSI would provide a 15% gain in efficiency, but this is only a small component of the potential reclaimed energy.

The otherwise wasted pressure can be used to help drive down a reclaim power stroke. The otherwise wasted heat can be utilized by injecting either a gas or liquid into the reclaim cylinder where the remaining heat energizes the injected substance, expanding it rapidly just as in the fuel burning cylinder, creating pressure that drives the pistons down in the reclaim cylinders. The pressure and heat from the fuel burning cylinder work together to create a torque on the crankshaft by using waste components.

In an exemplary embodiment, about one-half of the fuel burning cylinders exhaust volume can be routed into one reclaim cylinder, with the remaining half of the fuel burning cylinders exhaust volume being routed into a second reclaim cylinder, maximizing wasted energy usage. Extra fuel is not required because the power stroke in a reclaim cylinder is using a portion of the 70% wasted energy that is otherwise simply pushed into the atmosphere.

Exhaust pollutants can also be reduced by treating the exhaust gas chemically, and collecting particulate because the heat has been extracted from the exhaust stream. A regular air filter or mechanical separation method can be used because the exhaust stream is now cooler. The otherwise wasted heat can therefore be converted to additional mechanical torque driving the engines crankshaft without any extra fuel burn. For every one power stroke from a fuel burning cylinder, two reclaim power strokes can be created, maximizing the moment arm thrust of a crankshaft at 90 degrees to the vertical piston travel. The result is up to a doubling of the thermodynamic efficiency of engines, which will correlate up to a doubling of miles per gallon of gas burned for transportation vehicles including automobiles and trucks. Pollution constituents will also be drastically reduced, not only because one-half of the pollutants are created per vehicle mile traveled, but also due to the neutralization of harmful exhaust gases and the collection of by-product exhaust particulate.

Four Cylinder Configuration for a Reclaim Engine

Figure 2:
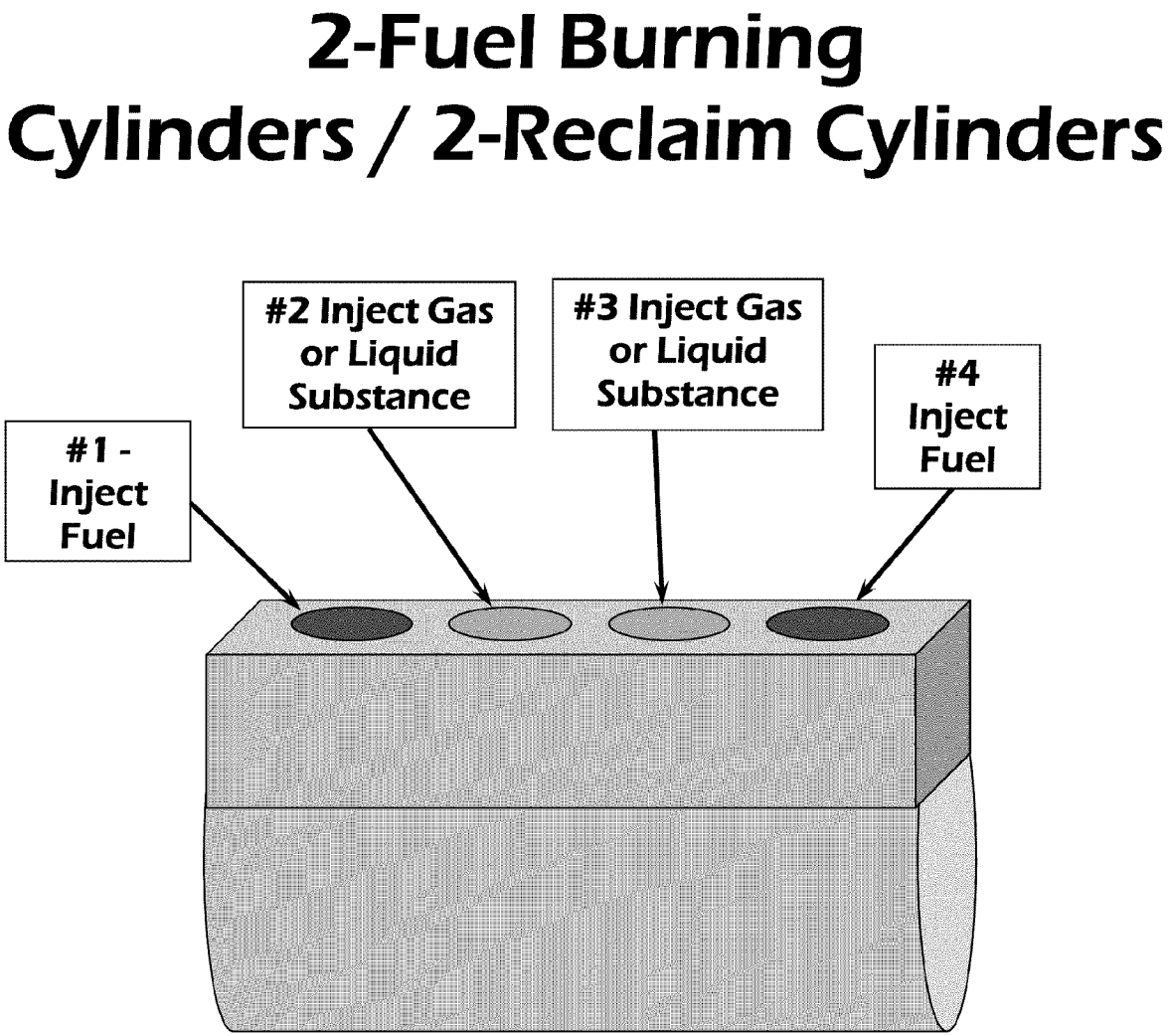
FIG. 2 depicts what is injected into each of the cylinders.

An embodiment of a 4 cylinder configuration for a reclaim engine is described below and with reference to FIGS. 1-13. For convenience, the four cylinders can be numbered from front to back as cylinders #1, #2, #3, and #4 as shown in FIG. 1. Cylinder #1 can be a fuel burning cylinder, cylinder #2 can be a reclaim cylinder, cylinder #3 can be a reclaim cylinder, and cylinder #4 can be a fuel burning cylinder. As shown in FIG. 2, fuel can be injected into cylinders #1 and #4, and a gas or liquid substance can be injected into cylinders #2 and #3.

Associated with each of the cylinders is a piston with the same numbering convention. Pistons #1 and #4 can be in timed sequence, meaning both are at top-dead-center (TDC) at the same time. Piston #2 can be 180 degrees offset from the pistons in cylinders #1 and #4. That is, when pistons #1 and #4 are at TDC, piston #2 will be at bottom-dead-center (BDC). The #3 piston can be at 50% of the travel in its cylinder, or 90 degrees behind piston #2. The reason for this offset is to remove backpressure from the fuel burning cylinders and maximize the fulcrum advantage on the crankshaft for the reclaim cylinder pistons.

Figure 3:
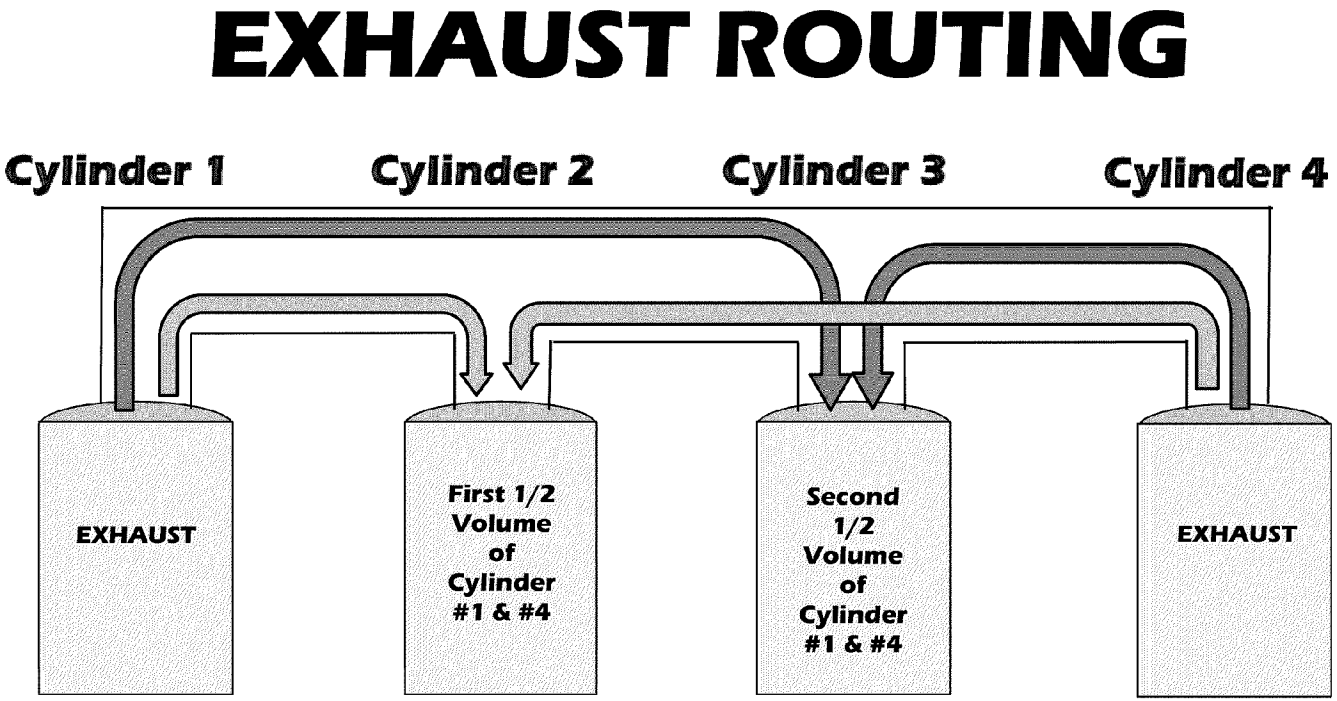
FIG. 3 shows how in a 4 cylinder engine the hot exhaust gas flows to the reclaim cylinders.

FIG. 3 illustrates how in the 4 cylinder engine, the hot exhaust gas can flow to the reclaim cylinders. The first one-half of the volume of the exhaust gas from cylinder #1 during the exhaust stroke in cylinder #1 is routed to the #2 cylinder (the first reclaim cylinder). After this first one-half volume is transferred to the #2 cylinder, the intake valve in cylinder #2 shuts, and the intake valve in the reclaim cylinder #3 (the second reclaim cylinder) opens. The second one-half of the volume of exhaust gas in cylinder #1 is then routed to cylinder #3. When the cylinder #1 reaches TDC, its exhaust valve shuts, as does the intake valve in cylinder #3. 180 degrees of crankshaft rotation later, the same exhaust gas transfer takes place from cylinder #4 to the reclaim cylinders. The first one-half of the volume of the exhaust gas from cylinder #4 during the exhaust stroke in cylinder #4 is routed to the #2 reclaim cylinder. After this first one-half volume is transferred to the #2 cylinder, the intake valve in cylinder #2 shuts, and the intake valve in the reclaim cylinder #3 opens. The second one-half of the volume of exhaust gas in cylinder #4 is then routed to cylinder #3. When the cylinder #4 reaches TDC, its exhaust valve shuts, as does the intake valve in cylinder #3.

Figure 4:
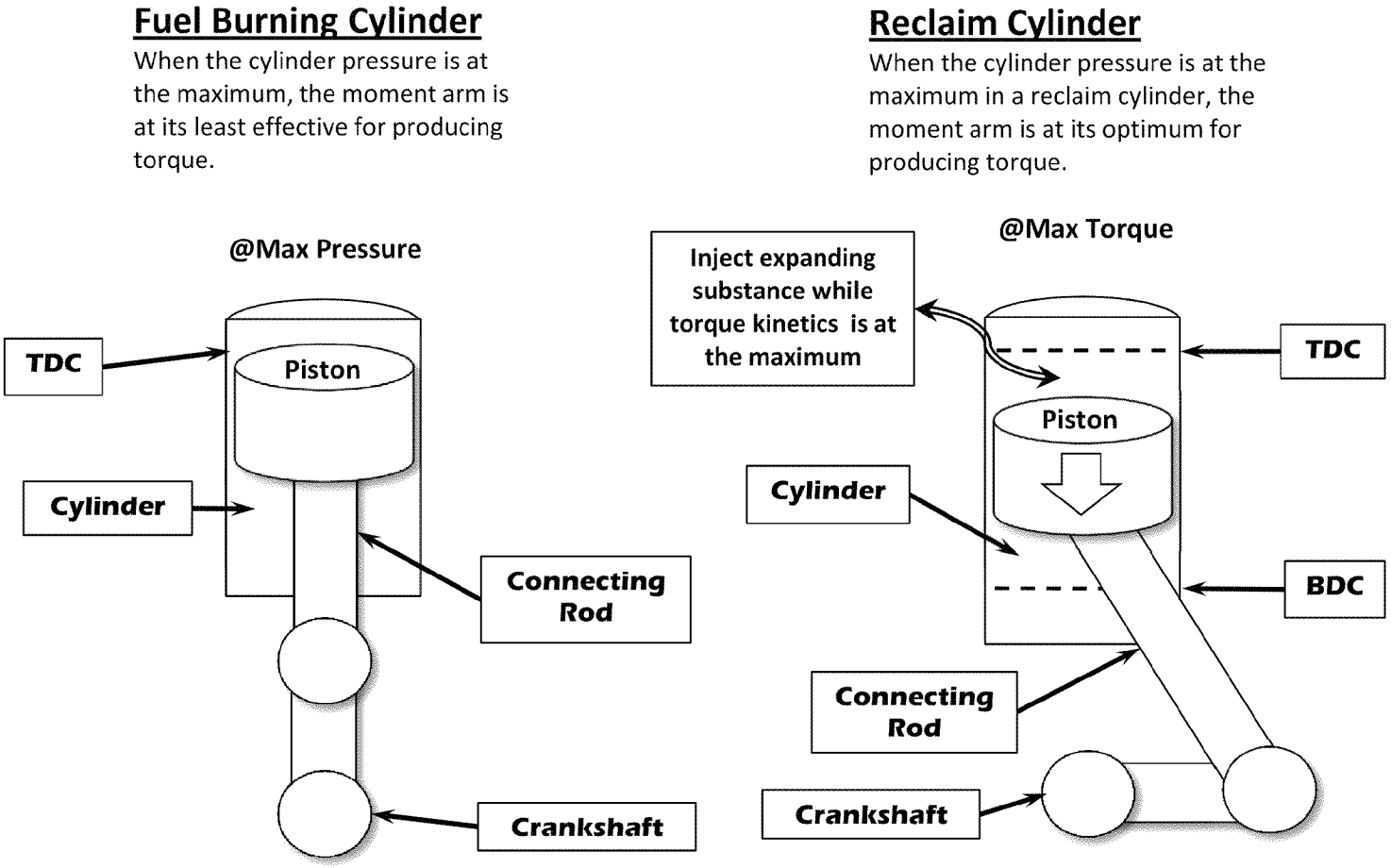
FIG. 4 illustrates a fuel burning cylinder and a reclaim cylinder.

FIG. 4 shows that when a fuel burning piston is at the top of the power stroke, the maximum cylinder pressure is created at this point when the fuel ignites, producing pressure because the air in the cylinder is rapidly heated. Because the crankshaft is in its vertical position, the foot-pounds force developed on the crankshaft is negligible. In a reclaim cylinder, the maximum cylinder pressure is created at the position where the crankshaft is 90 degrees, or perpendicular to the vertical axis travel of the piston. This 90 degree position relevant to the crankshaft optimizes the foot-pound torque generated on the crankshaft, when the reclaim cylinder pressure is at its maximum.

Figure 5:
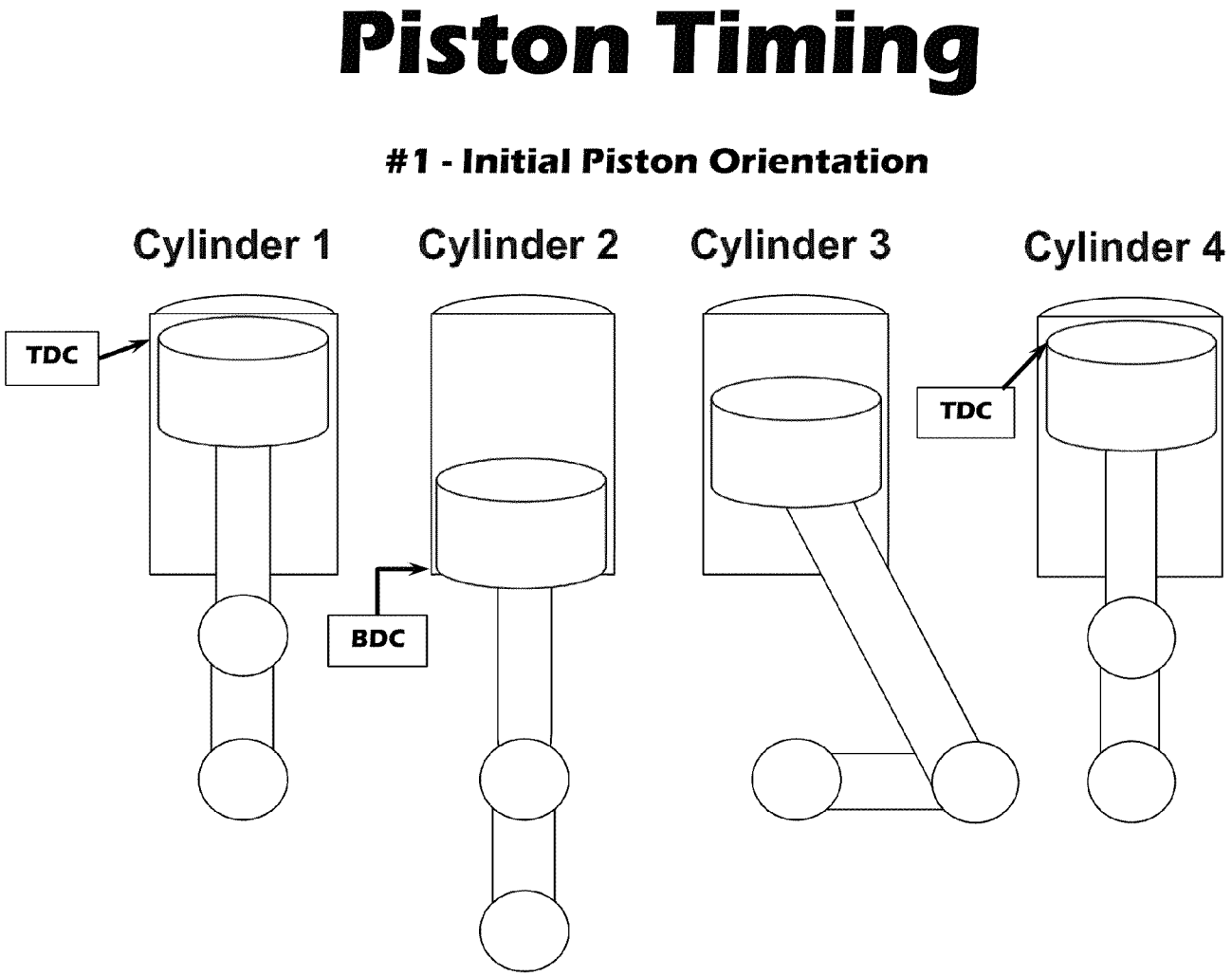
FIGS. 5-13 illustrate the sequencing of each piston of a four-cylinder embodiment of an engine, shown in 90 degree increments of travel.

FIGS. 5-13 illustrate the sequencing of each piston in 90 degree travel increments. In contrast to conventional internal combustion technology where each cylinder and piston works completely independently of the other cylinder's functioning, pistons in the reclaim engine embodiments described herein work in unison with the other pistons in the engine. The reclaim cylinders utilize the exhaust gas created in the fuel burning cylinders and can be completely dependent on the exhaust gas for operation, a totally different and new concept for internal combustion technology. Referring to FIG. 5, the original positioning of the pistons to start the 720 degree cycle starts with the fuel burning pistons, #1 and #4, at top-dead-center. The #2 reclaim piston is bottom-dead-center, and #3 reclaim piston is following the #2 piston by 50% of the piston's vertical travel. The #3 position is half-way between TDC and BDC. The #3 piston is traveling downward.

Figure 6:
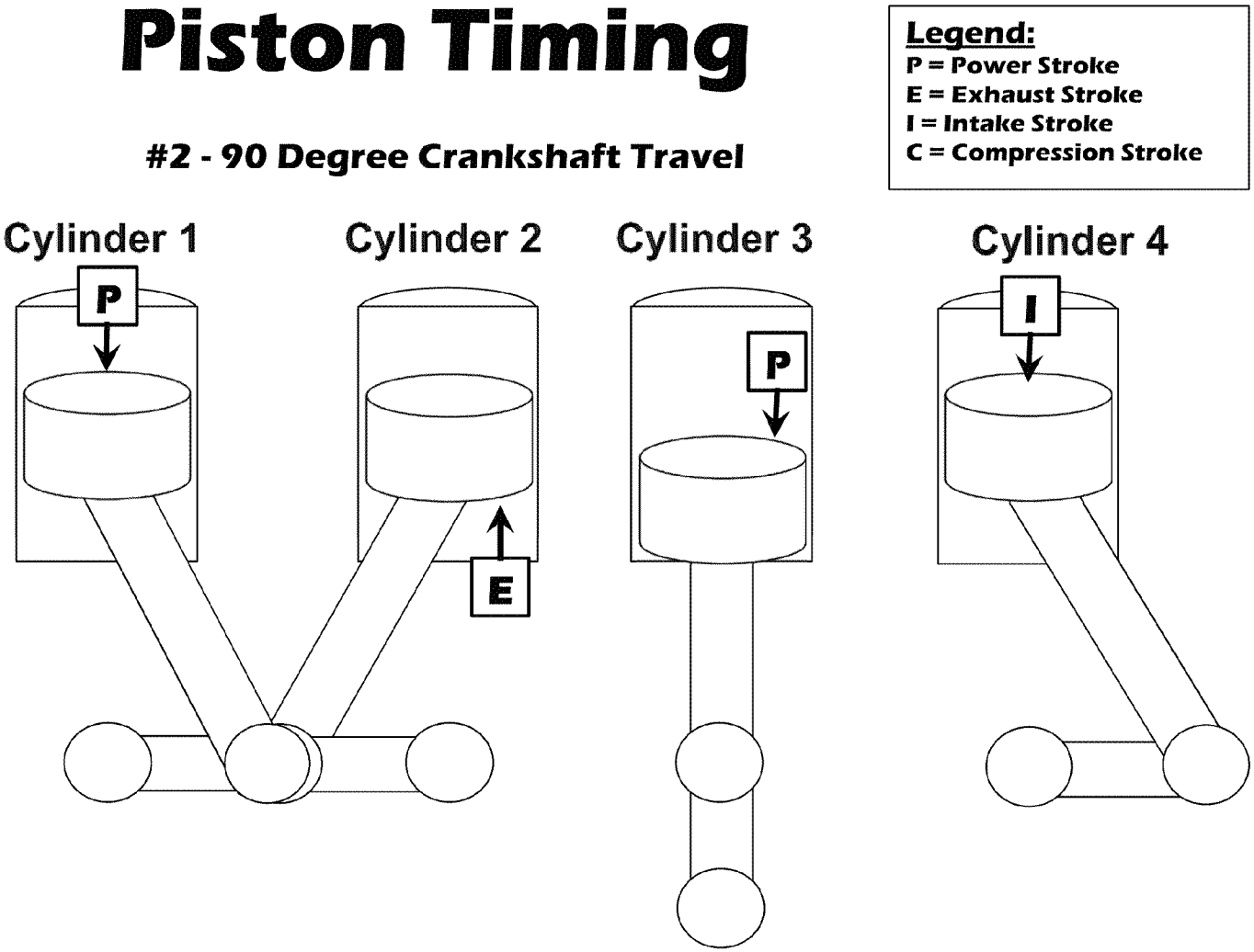

Referring to FIG. 6, the next piston sequence is described. FIG. 6 is a view of the piston position of the 4 cylinder engine after 90 degrees of travel from the initial piston positions. At this time, the #1 piston is at the midpoint of the cylinder going downward in a power stroke, the #2 piston is midpoint traveling upward on an exhaust stroke, the #3 piston is at BDC, and the #4 piston is midpoint during an intake stroke.

Figure 7:
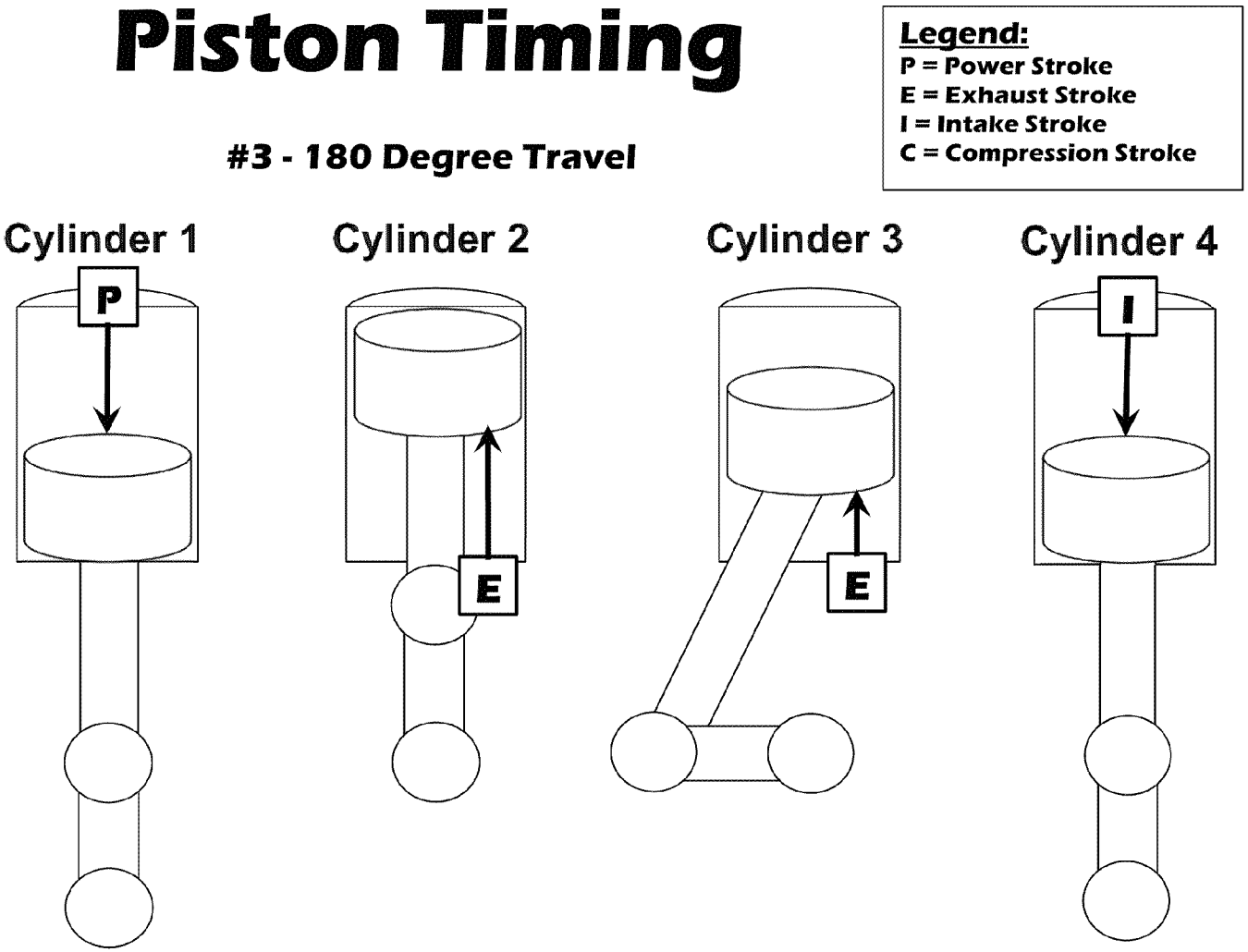

FIG. 7 is a view of the 4 cylinder engine after 90 degrees of travel from the piston positions of FIG. 6. At this time, the #1 piston is at BDC after a power stoke, the #2 piston is TDC after an exhaust stroke, the #3 piston is midpoint traveling upward during an exhaust stroke, and the #4 piston is BDC after an intake stroke.

Figure 8:
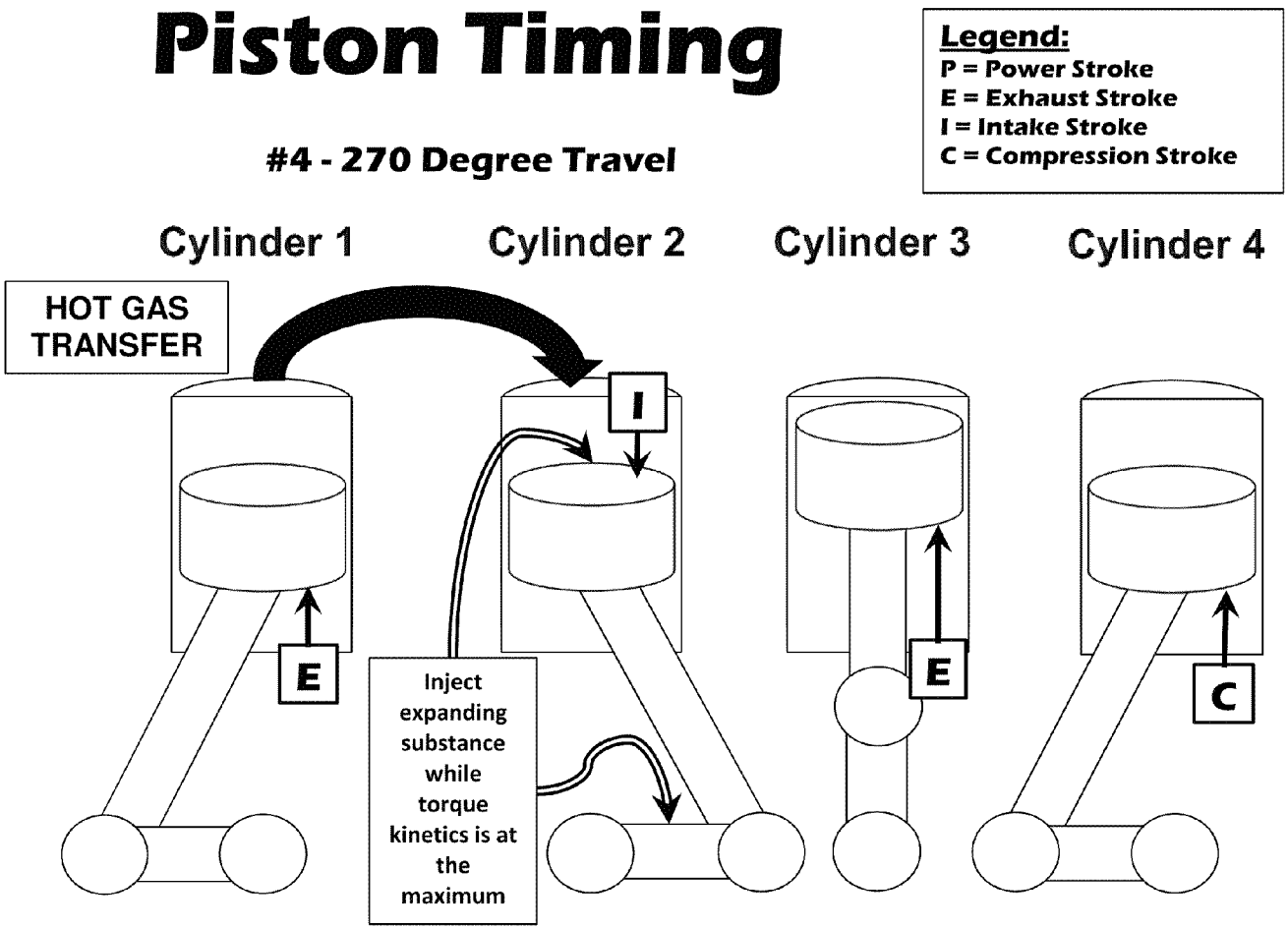

FIG. 8 is a view of the 4 cylinder engine after 90 degrees of travel from the piston positions of FIG. 7. The #1 piston has just completed its first one-half of travel on an exhaust stroke, and has pushed the first one-half volume of exhaust gas from cylinder #1 into reclaim cylinder #2. The gas or liquid expanding substance is injected into cylinder #2 at this point, creating maximum #2 cylinder pressure. The #3 piston is at TDC after an exhaust stroke, and the #4 piston is midpoint traveling upwards in a compression stroke.

Figure 9:
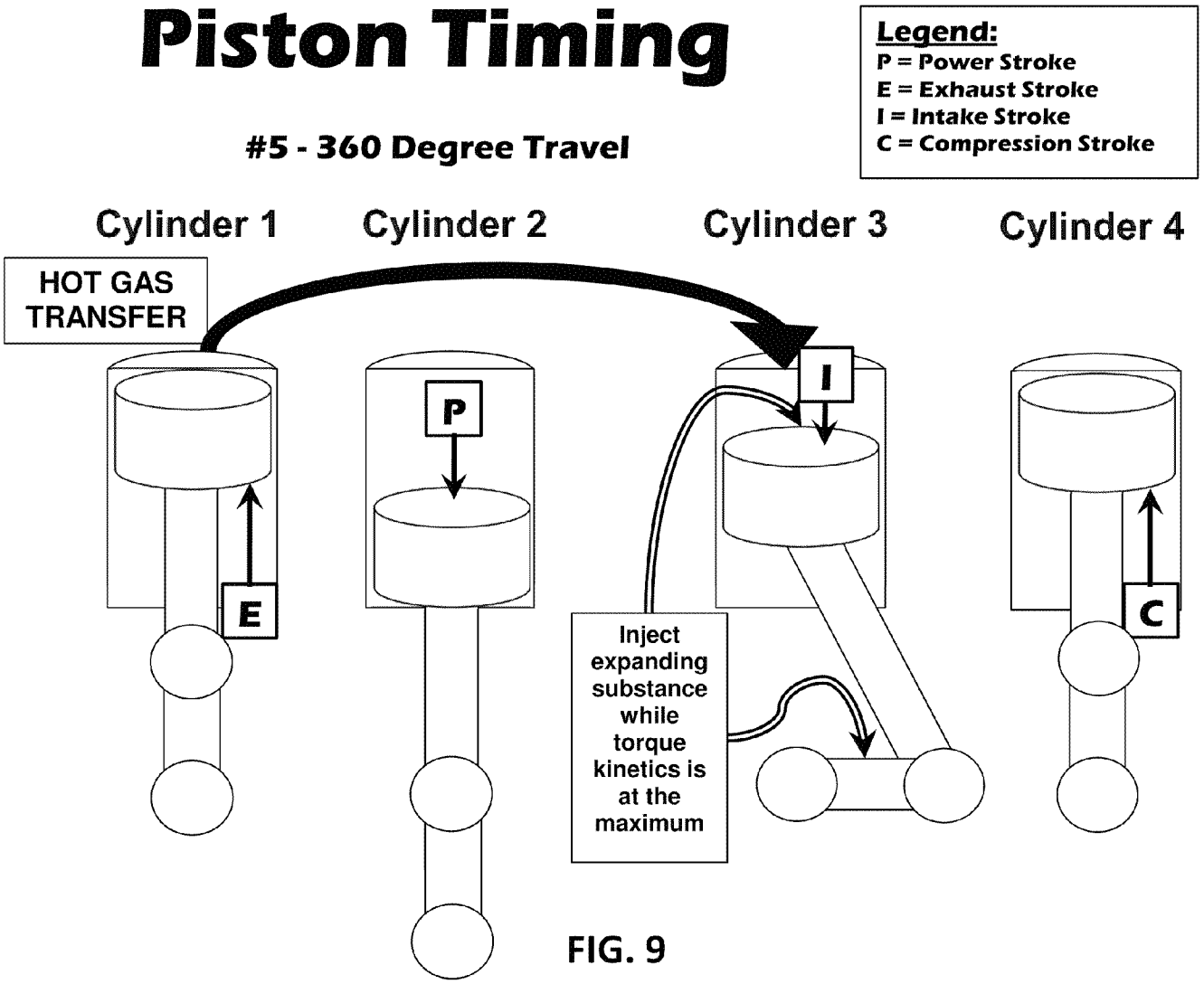

FIG. 9 is a view of the 4 cylinder engine after 90 degrees of travel from the piston positions of FIG. 8. At this time, the #1 piston has just completed the second one-half travel of an exhaust stroke, and has pushed the second one-half volume of exhaust gas from cylinder #1 into reclaim cylinder #3. A gas or liquid expanding substance is injected into cylinder #3 at this time, creating maximum #3 cylinder pressure. The #2 piston is BDC after a 50% travel power stroke, and the #4 piston is TDC after a compression stroke.

Figure 10:
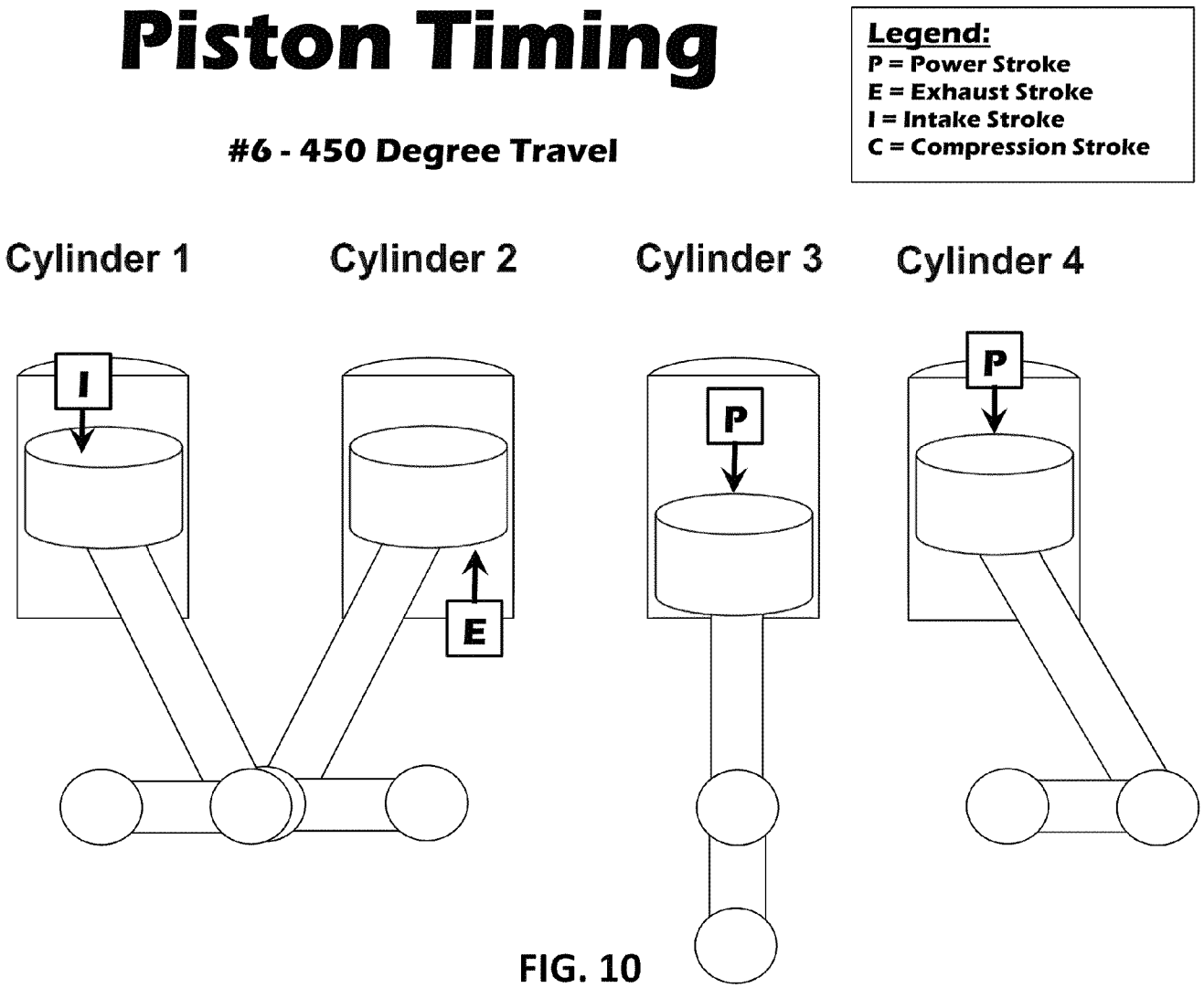

FIG. 10 is a view of the 4 cylinder engine after 90 degrees of travel from the piston positions of FIG. 9. The #1 piston is now midpoint in an intake stroke, the #2 piston is traveling upward in an exhaust stroke, the #3 piston is BDC after a 50% travel power stroke, and the #4 piston is midpoint in a downward power stoke.

Figure 11:
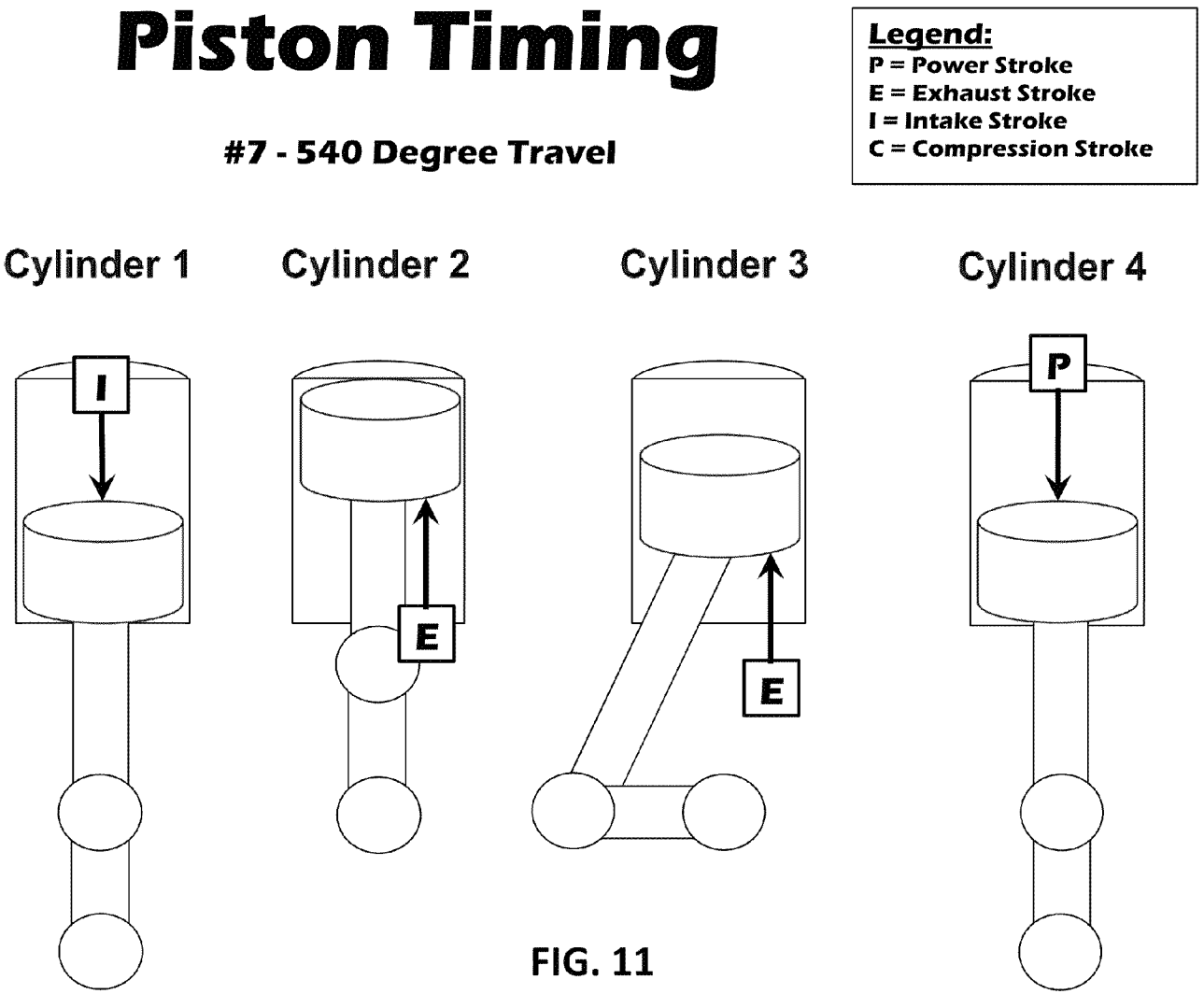

FIG. 11 is a view of the 4 cylinder engine after 90 degrees of travel from the piston positions of FIG. 10. The #1 piston is now BDC after an intake stroke, the #2 piston is TDC after an exhaust stroke, the #3 piston is midpoint during an upward exhaust stroke, and the #4 piston is BDC after a power stroke.

Figure 12:
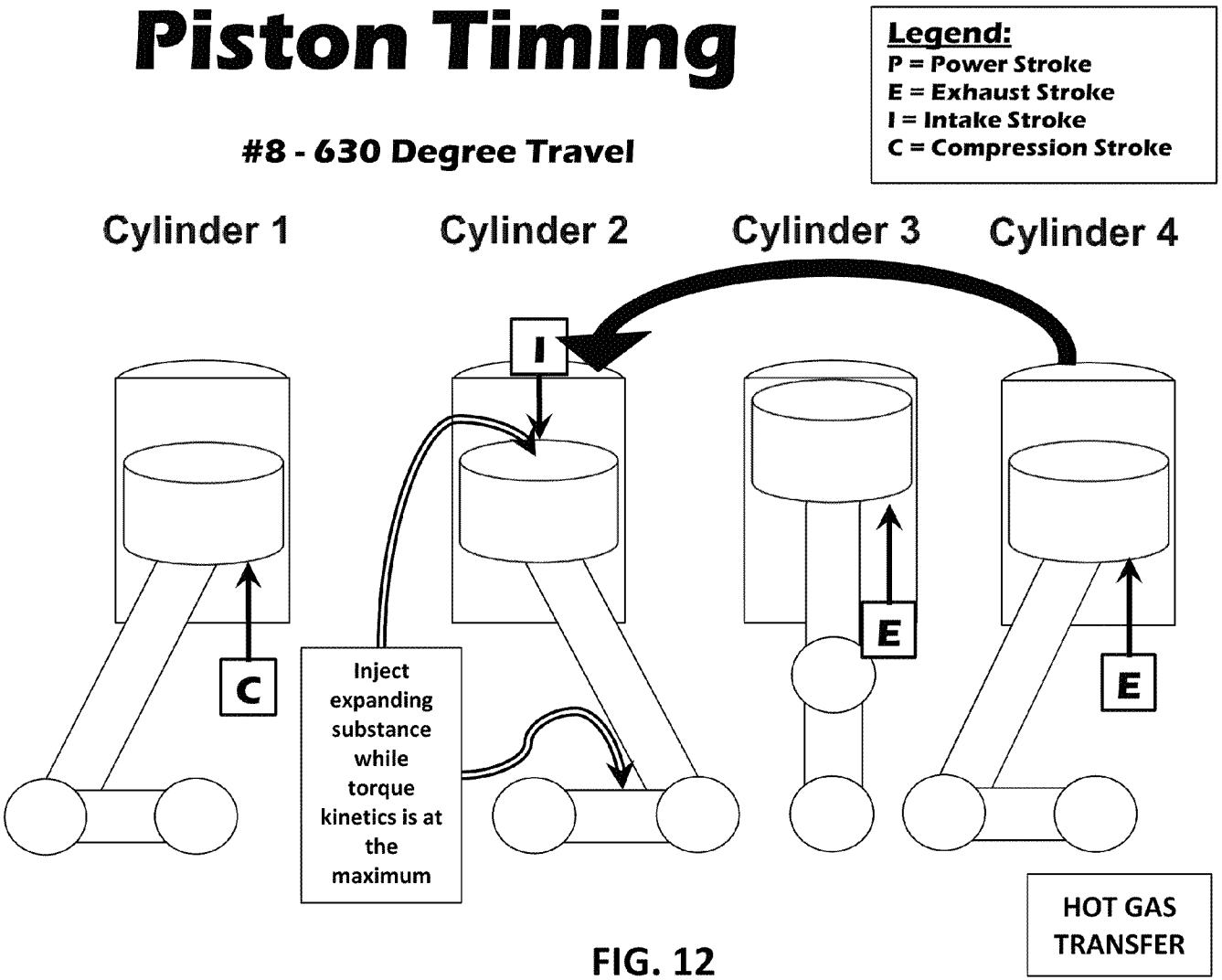

FIG. 12 is a view of the 4 cylinder engine after 90 degrees of travel from the piston positions of FIG. 11. The #4 piston has now completed its first one-half of travel on an exhaust stroke, and has pushed the first one-half volume of exhaust gas from cylinder #4 into reclaim cylinder #2. The gas or liquid expanding substance is injected into cylinder #2 at this point, creating maximum #2 cylinder pressure. The #3 piston is at TDC after an exhaust stroke, and #1 piston is midpoint traveling upwards in a compression stroke.

Figure 13:
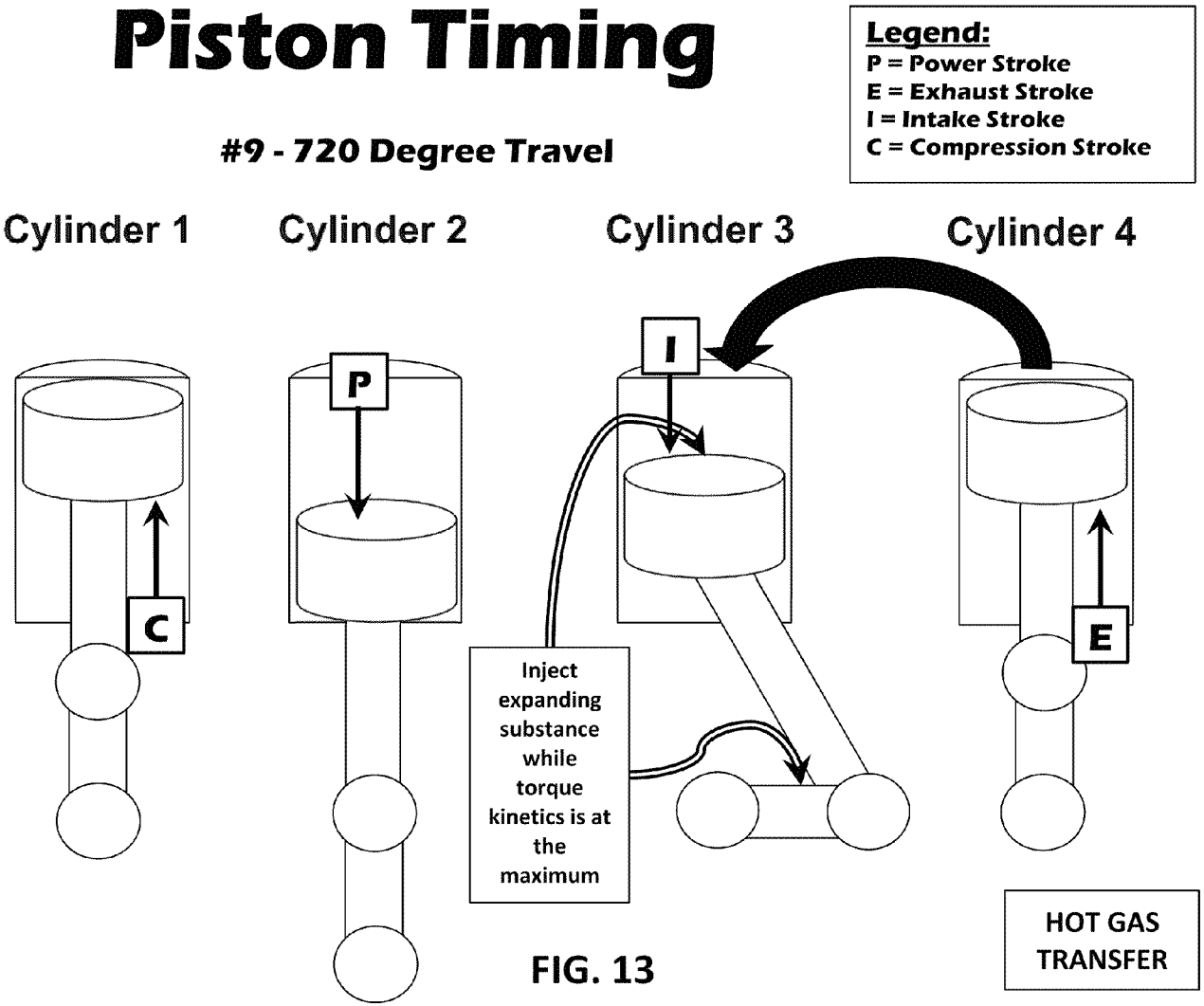

FIG. 13 is a view of the 4 cylinder engine after 90 degrees of travel from the piston positions of FIG. 12. The #4 piston has now completed the second one-half travel of an exhaust stroke, and has pushed the second one-half volume of exhaust gas from cylinder #4 into reclaim cylinder #3. The gas or liquid expanding substance is injected into cylinder #3 at this time, creating maximum #3 cylinder pressure. The #2 piston is BDC after a 50% travel power stroke, and #1 piston is TDC after a compression stroke.

The sequence of the cylinders and pistons timing in four—180 degrees of travel can thus be described as follows:

#1 power, #4 intake, #2 exhaust, #3(½ power—½ exhaust) (FIGS. 6 and 7)

#1 exhaust, #4 compression, #2 (½ exhaust pressure "intake"—½ power), #3 (½ exhaust—½ exhaust pressure "intake") (FIGS. 8 and 9)

#1 intake, #4 power, #2 exhaust, #3 (½ power—½ exhaust) (FIGS. 10 and 11)

#1 compression, #4 exhaust, #2 (½ exhaust pressure "intake"—½ power), #3 (½ exhaust—½ exhaust pressure "intake") (FIGS. 12 and 13)

The offset in timing with the piston in cylinder #3 allows the intake valves in cylinders #2 and #3 to be shut before the gas or liquid substance is injected into their respective cylinders. With the intake valves shut, there will be little or no back pressure against the exhaust stroke of the fuel burning cylinders. This can maximize the torque on the crankshaft in cylinders #2 and #3 because the cylinder pressure is created immediately before the crankshaft is at 90 degrees. At 90 degrees, the fulcrum of the crank is at its greatest mechanical leverage. There is also a conservation of energy with this method. The reclaim cylinders will only use ½ of the volume of exhaust from the fuel burning cylinders. Any volume of hot exhaust gas beyond the ½ volume is not maximized in the reclaim cylinder, because it is used past the 90 degree highest mechanical fulcrum point of the crankshaft. When the intake valve is shut in cylinder #2, the intake valve in cylinder #3 is opened.

The exhaust gas from the fuel burning cylinders is maximized by creating power from the otherwise wasted heat energy in the reclaim cylinders, and the reclaim cylinders use all the energy available from the fuel burning cylinders, without creating any back pressure. Once the intake valve is shut in cylinder #2, the gas or liquid substance is injected into this cylinder. The heat from the exhaust gas creates immediate pressure in the cylinder by expanding the gas or vaporizing the liquid. This pressure is created at the maximum fulcrum point of the crankshaft, creating maximum torque (ft/lbs) on the crankshaft. This same torque is created in the #3 cylinder; the intake valve is open for 40% of the travel distance downward, then shuts, and the gas or liquid substance is injected into this cylinder at the maximum fulcrum of the crankshaft.

In 720 degrees of crankshaft travel in a 4 cylinder reclaim engine there will be the equivalent of 6 power strokes. In the same 720 degrees of crankshaft travel in a conventional 4 cylinder internal combustion engine there are only 4 power strokes. In a conventional engine, the maximum cylinder pressure is created at TDC of the piston, when the fulcrum of the crankshaft is at its least possible mechanical leverage. By the time the crankshaft is at its maximum fulcrum leverage the cylinder pressure has been reduced by more than ½, which is a waste of a large amount of energy. The reclaim cylinders create the maximum pressure on the pistons when the crankshaft is at its maximum fulcrum leverage.

Maximum Leverage Advantage

One of the major mechanical advantages of the reclaim engine is the relationship of the crankshaft position to the piston location when maximum cylinder pressure is created. When the piston has traveled to the half-way point between Top-Dead-Center and Bottom-Dead-Center in the reclaim cylinder, the crankshaft is at the maximum lever arm of its rotation. In other words, the maximum leverage for the piston and connecting rod to do work on the crankshaft is when the crankshaft is at 90 degrees to its vertical position.

For example, if a 200 pound individual is riding a bicycle, when the pedals are vertical, one at the top of the rotation, and the other pedal is at the bottom of the rotation, no torque is created until the pedal goes past the Top-Dead-Center point. The 200 pound individual could weigh 1,000 pounds, but all the force is pushing straight down on the shaft connecting the two pedals when the pedals and shaft are vertical. No torque is being created until after the top pedal goes over center. The maximum torque created by the individual is when the pedal is half-way down toward the bottom of the rotation, at 90 degrees from the vertical pedal position.

A quantitative example would be as follows. The individual riding a bicycle weighs 200 pounds; the length of the bicycle pedal rod that connects the rotational sprocket shaft to the pedal is 1 foot long. When the pedals are straight up and down, the torque created on the rotational shaft is Weight× Length of shaft from the vertical axis, or 200 pounds×0 feet=0 foot-pounds. When the connecting shaft is 90 degrees in relation to the vertical position, the torque is at its maximum, or 200 pounds×1 foot=200 foot-pounds of torque.

This is analogous to what happens in an internal combustion engine. When the cylinder pressure is at its maximum, the piston is at the top of the stroke, which is creating 0 foot-pounds of torque on the crankshaft. When the piston is half-way down the power stroke, the maximum lever arm is at 90 degrees from the vertical crankshaft position, but the cylinder pressure is less than one-half of what it was at the maximum cylinder pressure, at the top of the stroke. And even though the cylinder pressure is one-half the maximum cylinder pressure, the highest torque on the crankshaft is created at this 90 degree to vertical position.

Figure 14:
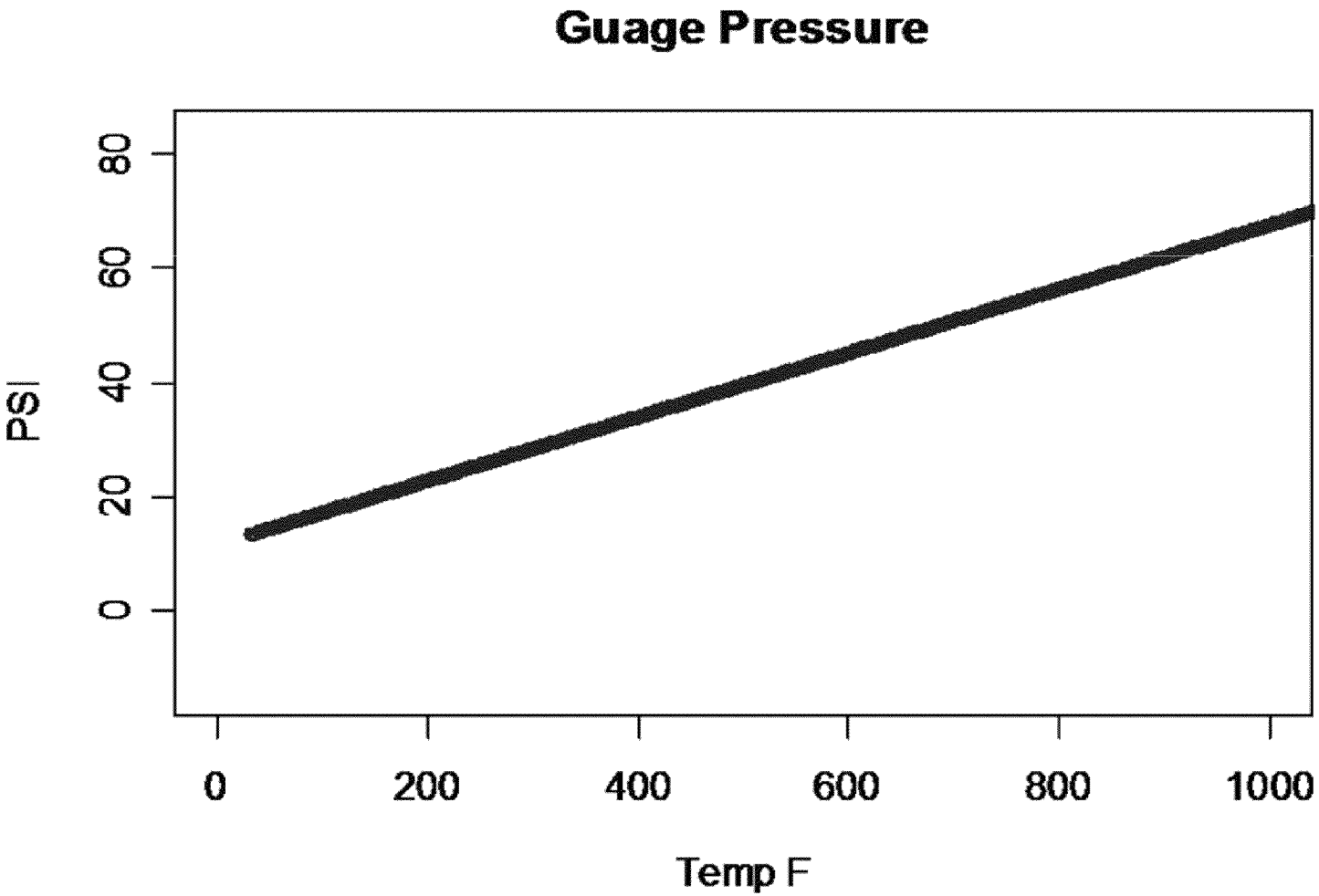
FIG. 14 illustrates a graph of air pressure relative to temperature.

In a reclaim cylinder, the maximum cylinder pressure coincides with the 90 degree position of the crankshaft, which is the half-way position of the piston between TDC and BDC. When ambient air is injected into the reclaim cylinder, using the 800 degrees Fahrenheit heat of the exhaust gas that is captured in the reclaim cylinder, the injected volume of air will try to increase 4 times, but because it is captured in a confined volume, the air pressure will increase instead, as indicated in FIG. 14. The reclaim power of the engine will be determined by the volume of air that is injected into the reclaim cylinder. The reclaim cylinder will contain exhaust gas from the fuel combusting cylinders that is 800 degrees Fahrenheit and will have a pressure of at least 23 pounds per square inch. Just this normally wasted pressure by itself will create an engine that is 15% more efficient, but by injecting additional air into the reclaim cylinder, the efficiency of the internal combustion engine can improve by about 33% or more, and can be up to 100% more efficient. The trade off when compressing the air so that it can be injected, is that regardless of the power it takes to compress the air, the power being supplied by the output of the reclaim engine, when injected into the reclaim cylinder the injected air pressure will increase the cylinder pressure 4 fold.

The more power it takes to compress the air, the higher the net power output of the engine due to the value of this multiplying factor. A similar example where this proportional advantage exists today is in turbo charging. While it does take a definitive amount of input power to propel a turbo charger, the benefit gain in total power increase for the engine outweighs the power input it takes to drive the turbocharger. As long as the total output power of a reclaim engine is greater than the power it takes to compress the injected air, then there will always be an efficiency and power gain, just as in the case of a turbo, but on a much larger scale.

This is possible because of the heat energy in the exhaust gas. Instead of being wasted, this high energy heat source will now be put to good use. The other potential opportunity that exists is for a second set of reclaim cylinders if there is sufficient heat and pressure that remains at the end of the first reclaim cylinder power stroke. Thus, instead of a 4 cylinder internal combustion engine, a six cylinder internal combustion engine can be provided. After the initial reclaim is complete, the 2 reclaim cylinders exhaust would be routed to 2 additional reclaim cylinders to remove most if not all the pressure and heat from the exhaust system that was created in the initial fuel burning cylinders. (The objective of a reclaim concept is to ultimately have ambient temperature exhaust gas fall out of the end of the tail pipe.) This additional energy reclaim can also add additional horsepower to the engine.

A Sliding Scale of Efficiency Gain

Air is the simplest substance for injection into the reclaim cylinders to increase the efficiency of an internal combustion engine. Air will always be present as long as the internal combustion engine is running because air is required for fuel combustion in the fuel burning cylinders. Air is free, it requires no transportation, it is readily available, and by increasing the efficiency of an internal combustion engine, less fuel is required for the same given power output so the normal air emission pollutants are reduced in direct proportion.

Another aspect of a reclaim internal combustion engine is that the more gaseous energy that can be excited in the reclaim cylinders using the waste heat of the fuel burning exhaust gas, the higher the pressure that can be created at the maximum torque lever on the crankshaft. Ambient air will be excited in the internal reclaim cylinder just described, which will increase efficiency, but for example, if liquid nitrogen is injected into the reclaim cylinder instead of ambient air, the efficiency of an internal combustion engine could be increased even further. The trade-off to this approach is that liquid nitrogen had work performed on the gaseous state to turn it into a liquid state. The contained liquid nitrogen now has stored potential energy within a container that when coupled with the waste heat in a reclaim cylinder, will increase the pressure of the gases within the reclaim cylinder still higher, increasing the torque on the crankshaft. There is a sliding power reclamation scale of gases and solutions that can be injected into a reclaim cylinder to improve the efficiency of an internal combustion engine. Ambient air is at the lower end of the scale. Liquid nitrogen is at the higher end, but other gases and liquid solutions are also available which will increase internal combustion reclaim engine efficiency. A solution of water for example may be in between the lower and top of the scale. Liquid air or liquid helium can also be utilized.

Fuel

The fuel used in the fuel burning combustion cylinders can be gasoline, diesel, Bio-diesel, ethanol, LPG, LNG, etc. Any fuel which generates heat in an internal combustion engine can be used, as it is the wasted pressure and heat in the exhaust stream that is being reclaimed. Desirably, the reclaim engine can reduce the fuel required for vehicle travel by up to 33% and possibly up to 50%.

Modification of Conventional Internal Combustion Engine

The following embodiment incorporates modified valve cams, crankshaft reconfigurations, rerouting of intake and exhaust porting, and retiming of a portion of the cylinder injectors to modify a conventional internal combustion engine to operate as a reclaim engine as described herein. Because the embodiments described herein do not significantly alter any current technology prior to or during the combustion stroke or the exhaust stroke in the combusting cylinder, major retooling can be minimized.

Figure 15:
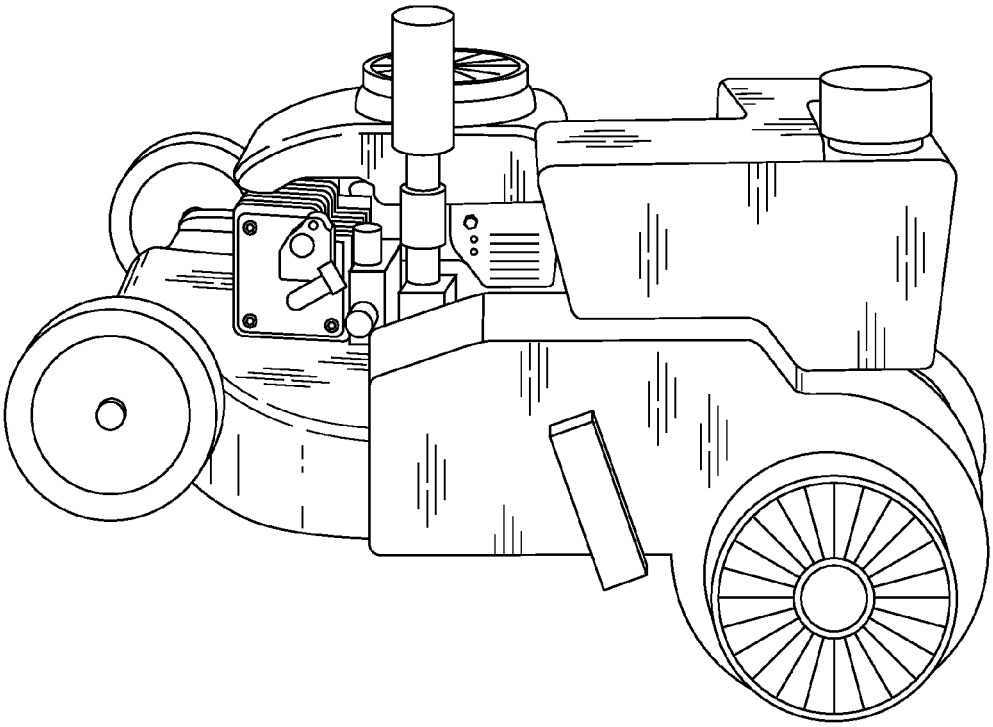
FIG. 15 illustrates a first single cylinder engine, namely a horizontal shaft engine.
Figure 16:
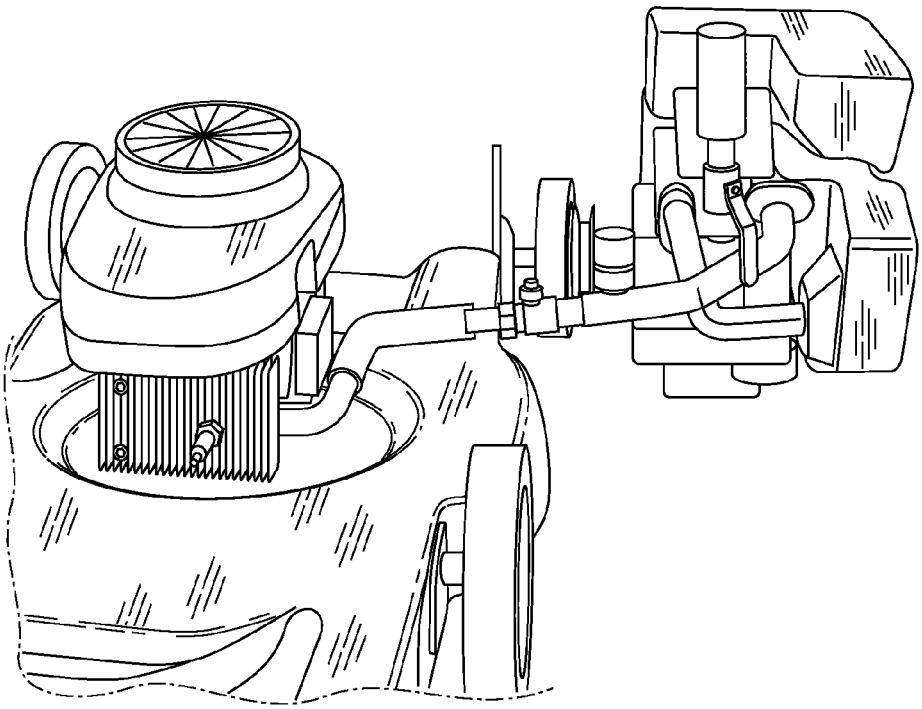
FIG. 16 illustrates a second single cylinder engine, namely vertical shaft engine.

For demonstration purposes two single cylinder engines are used. The first is a 5.0 hp, 195 cc, horizontal shaft engine, shown in FIG. 15. The second "cylinder" is a modified vertical shaft lawn mower engine, with valving modified to replicate what is defined in this design as a "reclaim" cylinder, shown in FIG. 16. The exhaust pressure from cylinder #1 will drive the piston in the modified cylinder #2. The #2 cylinder runs strictly off the exhaust gas pressure created from the combustion in cylinder #1.

The next component of energy reclaimed provides a much higher value then the wasted pressure. An approximation of thermodynamic efficiency for a gasoline internal combustion engine is around 30%. Of course, there are mechanical losses when converting the BTU energy available in fuel to usable torque, but there is also a huge amount of heat energy wasted, exhausted into the atmosphere. The following is an example on how to convert wasted heat into mechanical energy.

An illustration for recovering mechanical energy out of the heated exhaust stream uses the same two "cylinders" (engines) from the previous example. Although the horizontal shaft, 195 cc single cylinder gas engine is advertised as a 5.0 hp, the actual dynamometer hp of this engine is 3.8 hp.

The exhaust heat from the combusting cylinder #1, under no-load, can exceed 800 degrees Fahrenheit, and in this example was measured at about 838 degrees Fahrenheit. Desirably this wasted heat could be cooled back down to ambient 70 degrees Fahrenheit, converting the extracted heat energy into mechanical torque. The theoretical available horsepower can be calculated by the thermodynamic formula:

$$Q=1.09(cfm)(\text{delta } T)$$

Where cfm is equal to 3600 RPM/*2×(195 cc/16.4 cc/cubic inch) or 21,420 cubic inches exhausted per minute. * A 4 stroke produces exhaust once every two revolutions.

21,420 cubic inches/minute×1 cubic foot/1728 cubic inches=12.4 cfm.

Delta T theoretically could be calculated by using 800 F minus 70 F or 730 degrees F.

Q would then equal 1.09×12.4 cfm×730 F. or 9866 btuh.

Converting to horsepower:

9866 btuh×1 kW/3412 btuh×1.34 hp/kW=3.87 hp.

3.87 reclaimed hp/3.8 actual hp=102% efficiency gain . . . but this doesn't allow for any mechanical losses or the fact that reaching ambient may not be achievable initially.

So assuming at least 300 degrees F. can be reclaimed instead of the entire 730 degrees delta F.

Again:

$$Q=1.09(12.4\text{ cfm})(300\text{ F})=4055\text{ btuh.}$$

Hp=4055 btuh×1/3412 btuh×1.34 hp/kW=1.6 hp 1.6 hp/3.8 actual hp=42% efficiency increase.

Adding the heat component reclaim efficiency plus the PSI reclaim component and adjusting for mechanical losses is equal to;

(42%+15%)×*0.6=34.2% efficiency reclaim from the wasted exhaust stream. (The value 0.6 assumes a 40% mechanical loss.)

As previously indicated, this 33% efficiency gain is a minimum value. It could be much higher, over 115% theoretically. The embodiments described herein are reclaim engines that provide the ability to convert this waste stream into usable mechanical energy. Using the exhaust stream heat to vaporize water drives the piston in the reclaim cylinder significantly faster. A gas, such as air, will provide the same energy increase. By using the wasted heat and pressure of a fuel burning cylinder, and adding either a gas that will expand or a liquid that will vaporize, the subsequent pressure in the reclaim engine will drive the reclaim piston down, turning the crankshaft, and adding torque to an engine without burning any more fuel. This is the method for making an internal combustion engine more efficient, which can double the fuel mileage currently being experienced in the transportation market today.

In summary, in cylinder #1, where the gasoline/air combustion process takes place, heat, pressure, and emissions are generated. In cylinder #2, heat and pressure is reclaimed, and treatment of emissions would take place. What is created in the #1 cylinder, including the heat, pressure, and emissions is recovered in cylinder #2, which develops at least 33% more usable torque, and could nearly eliminate emissions. The exhaust waste stream, because it is cool, can now be filtered, and the evaporative solution separated and recycled for continuous use. Particulate filtration would be especially useful in cleaning up diesel exhaust. The oxides will be neutralized by additives to the injected substance.

The embodiments described herein can be used with any number of cylinder configurations that use internal combustion technology. Any multiple-cylinder internal combustion engine can use reclaim cylinders to recapture wasted pressure and heat from the fuel burning cylinder. That is, reclaim cylinders can be used with any combination of fuel burning cylinders, regardless of how many fuel burning cylinders there are in the engine. In the exemplary embodiment described above, two fuel burning cylinders and two reclaim cylinders are provided. However, it should be understood that reclaim cylinders can be used with engines that have at least two cylinders. Although there is no specific upper limit for the number of cylinders with which reclaim cylinders can be used, generally internal combustion engines do not have more than sixteen cylinders.

Moreover, an engine using both fuel burning cylinders and reclaim cylinders need not have the 1:1 ratio of fuel burning cylinders to reclaim cylinders as provided in the example above. For example, in a six cylinder engine there can be two fuel burning cylinders and four reclaim cylinders, or, alternatively, four fuel burning and two reclaim cylinders. Likewise, in an eight cylinder engine, the ratio of fuel burning cylinders to reclaim cylinders can be 1:1 such that there are four fuel burning and four reclaim cylinders, or the ratio can be higher or lower (e.g., six fuel burning cylinders and two reclaim cylinders).

In addition, the economic gains beyond better fuel mileage and lower emissions include a much simpler engine system design, saving money in manufacturing. Also, by cooling and neutralizing emissions in the reclaim cylinders, expensive post combustion emissions controls could possibly be eliminated, and radiator and engine cooling components could significantly be reduced.

In view of the many possible embodiments to which the principles of the disclosed embodiments may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. An internal combustion engine, comprising:

a first cylinder having a first piston, a first intake port, and a first exhaust port, the first cylinder being a fuel burning cylinder that receives fuel for compression and ignition within the first cylinder;

a second cylinder having a second piston, a second intake port, and a second exhaust port;

a third cylinder having a third piston, a third intake port, and a third exhaust port;

a fourth cylinder having a fourth piston, a fourth intake port, and a fourth exhaust port, the fourth cylinder being a fuel burning cylinder that receives fuel for compression and ignition within the fourth cylinder;

a first routing member configured to route exhaust from the first exhaust port to the second intake port;

a second routing member configured to route exhaust from the first exhaust port to the third intake port;

a third routing member configured to route exhaust from the fourth exhaust port to the second intake port; and a fourth routing member configured to route exhaust from the fourth exhaust port to the third intake port, wherein the second cylinder is a non-fuel burning cylinder configured to receive exhaust through the second intake port to drive the second piston without compressing and igniting the exhaust within the second cylinder, and the third cylinder is a non-fuel burning cylinder configured to receive exhaust through the third intake port to drive the third piston without compressing and igniting the exhaust within the third cylinder.

2. The engine of claim 1, wherein the first piston and the fourth piston are configured to be in timed sequence with each other.

3. The engine of claim 2, wherein the second piston is configured to be 180 degrees offset from the first and fourth pistons, and the third piston is configured to be 90 degrees behind the second piston.

4. The engine of claim 3, wherein each of the first, second, third, and fourth pistons is movable within their respective cylinders to provide a power stroke, an exhaust stroke, and an intake stroke.

5. The engine of claim 4, wherein the exhaust stroke of the first cylinder expels heated gas from the first exhaust port, and a portion of the heated gas expelled from the first exhaust port is directed to the second cylinder through the first routing member and into the second intake port, and a portion of the heated gas expelled from the first exhaust port is directed to the third cylinder through the second routing member and into the third intake port.

6. The engine of claim 5, wherein the heated gas expelled from the first exhaust port is directed to the second and third cylinders during their respective intake strokes.

7. The engine of claim 5, wherein the exhaust stroke of the fourth cylinder expels heated gas from the fourth exhaust port, and a portion of the heated gas expelled from the fourth exhaust port is directed to the second cylinder through the third routing member and into the second intake port, and a portion of the heated gas expelled from the fourth exhaust port is directed to the third cylinder through the fourth routing member and into the third intake port.

8. The engine of claim 7, wherein the heated gas expelled from the fourth exhaust port is directed to the second and third cylinders during their respective intake strokes.

9. The engine of claim 5, wherein the portion of the heated gas directed to the second cylinder through the first routing member is about the same as the portion of the heated gas directed to the third cylinder through the second routing member.

10. The engine of claim 7, wherein the heated gas expelled from the first and fourth exhaust ports is delivered to the second and third cylinders while the second and third pistons are substantially in mid-stroke of an intake stroke.

11. The engine of claim 1, wherein the ratio of fuel burning cylinders to non-fuel burning cylinders is 1:1.

12. The engine of claim 1, wherein the ratio of fuel burning cylinders to non-fuel burning cylinders is greater than 1:1.

13. The engine of claim 1, wherein the ratio of fuel burning cylinders to non-fuel burning cylinders is less than 1:1.

14. The engine of claim 1, comprising exactly four cylinders.

15. The engine of claim 1, wherein each of the fuel burning cylinders is a 4-cycle cylinder comprising a power stroke, an exhaust stroke, an intake stroke, and a compression stroke.

16. The engine of claim 1, wherein each of the non-fuel burning cylinders is a 3-cycle cylinder comprising a power stroke, an exhaust stroke, and an intake stroke.

17. The engine of claim 14, wherein each of the four cylinders operates in 360 degrees of crankshaft rotation.

* * * * *